US006814312B2

(12) United States Patent
Iwano et al.

(10) Patent No.: US 6,814,312 B2
(45) Date of Patent: Nov. 9, 2004

(54) FUEL INJECTION VALVE

(75) Inventors: Akira Iwano, Hekinan (JP); Takayuki Hokao, Anjo (JP)

(73) Assignee: Denso Corporation (JP)

( * ) Notice: Subject to any disclaimer, the term of this patent is extended or adjusted under 35 U.S.C. 154(b) by 21 days.

(21) Appl. No.: 10/280,026

(22) Filed: Oct. 25, 2002

(65) Prior Publication Data

US 2003/0085309 A1 May 8, 2003

(30) Foreign Application Priority Data

Nov. 6, 2001 (JP) ..... 2001-340629
Aug. 19, 2002 (JP) ..... 2002-238133

(51) Int. Cl.[7] ..... B05B 1/30; F02M 51/00; F02M 59/00; F02M 61/00; F02M 63/00

(52) U.S. Cl. ..... 239/585.1; 239/585.4; 239/533.2; 239/533.12; 239/533.14

(58) Field of Search ..... 239/585.1, 585.4, 239/533.2, 533.12, 533.14, 533.3, 533.9, 533.11, 585.5, 88–92; 251/129.15, 129.21

(56) References Cited

U.S. PATENT DOCUMENTS 5,193,747 A * 3/1993 Preussner ..... 239/288.5
5,273,215 A * 12/1993 Hans et al. ..... 239/288.5
5,323,966 A * 6/1994 Buchholz et al. ..... 239/408
5,716,010 A * 2/1998 Tada et al. ..... 239/585.1
5,862,991 A * 1/1999 Willke et al. ..... 239/397.5
6,186,418 B1 * 2/2001 Tani ..... 239/533.2

FOREIGN PATENT DOCUMENTS

| | | |
|---|---|---|
| JP | A-8-277763 | 10/1996 |
| JP | A-9-310651 | 12/1997 |
| JP | A-2000-145589 | 5/2000 |

* cited by examiner

*Primary Examiner*—Michael Mar
*Assistant Examiner*—Darren Gorman
(74) *Attorney, Agent, or Firm*—Nixon & Vanderhye PC

(57) ABSTRACT

A fuel injection valve that sprays a finer particulate fuel has a tightly closed valve portion and can be assembled by press-fitting. A cup-shaped injection hole plate has its entire circumference joined to a valve body, has a bottom portion with injection holes, and has a cylindrical portion provided upright from the peripheral edge of the bottom portion. A resin sleeve has a resin annular portion with an opening that opens toward the downstream direction of fuel sprayed from the injection hole plate, and a resin cylindrical portion provided upright from the peripheral edge of the resin annular portion. The injection hole plate is provided with projections and the sleeve is provided with cutout grooves to engage the projections.

17 Claims, 9 Drawing Sheets

FUEL INJECTION VALVE

CROSS REFERENCE TO RELATED APPLICATIONS

This application is based on, claims the benefit of priority of, and incorporates by reference the contents of prior Japanese Patent Application No. 2001-340629, filed on Nov. 6, 2001, and No. 2002-238133, filed on Aug. 19, 2002.

BACKGROUND OF THE INVENTION

1. Field of the Invention

The present invention relates to a structure for a spraying tip or end of a fuel injection valve that is applicable to a fuel injection valve that supplies fuel to an intake pipe of, for example, an internal combustion engine.

2. Description of the Related Art

Generally, fuel injection valves are known which, for example, are provided at the intake pipe of an internal combustion engine to supply fuel to the engine. Japanese Patent Laid-Open Publication Nos. Hei. 8-277763 and 9-310651 are examples of such a technology.

With improvements in the performance of internal combustion engines, there is a demand for cleaner exhaust emissions in connection with the fuel injection valves of this kind. In particular, improved valves are needed to further vaporize fuel so that the injected fuel spray is comprised of finer particles.

Japanese Patent Laid-Open Publication No. Hei. 8-277763 discloses means for achieving the above purpose. According to the disclosure of the document, a nozzle needle as a valve member forms a flow path that directs fuel toward an injection hole plate in cooperation with the internal circumferential wall of a nozzle body as a valve body. An extension of the tip of the nozzle needle at the outer circumference is positioned outside the circular shape of a plurality of injection holes provided at the tip of the nozzle body at the opening on the inlet side. After fuel strikes the tip of the nozzle body, in other words, the injection hole plate, the fuel forms streams toward the center along the upper surface of the injection hole plate, and the fuel is ejected from the injection holes provided on the way to the center.

According to Japanese Patent Laid-Open Publication No. Hei. 9-310651, while the streams toward the center are formed, the injection holes are provided in slanted directions so that the streams formed toward the injection holes do not interfere with each other around the center of the injection hole plate and do not impede the flow of injection.

In conventional arrangements, the fuel passes at an increased speed into the injection hole inlets positioned on the upper surface of the injection hole plate at the tip of the fuel injection valve. Therefore, the kinetic energy of the injected fuel can be increased and the fuel spray will be fine particles. However, the vacuum air stream in the intake pipe is mixed with the fuel spray injected from the injection holes and forms an air-fuel mixture. The conventional arrangements do not fully take into account the effect of this air stream upon fuel spraying.

Meanwhile, there is a known valve that includes a sleeve provided at the lower surface of the injection hole plate having openings concentric to the group of injection holes at the injection hole plate and having an enlarged diameter (see Japanese Patent Laid-Open Publication No. 2000-145589). According to Japanese Patent Laid-Open Publication No. 2000-145589, the sleeve is made of a resin material and press-fitted onto the outer periphery of the tip end of the fuel injection valve to make it secure.

However, the holding strength to fix the sleeve could be lowered by high temperature creep, etc., and its engagement to the outer periphery of the end of the injection valve could become loose or undone, permitting the sleeve to rotate. Meanwhile, in order to provide the holding strength by press-fitting, excessive compressive stress could be provided to the valve body that forms the end, so that the valve can not be closed as tightly as required when in a fully closed state.

When the holding strength by press fitting is low, the operator might inadvertently rotate the sleeve from a desired position when the injection fuel valve is attached.

SUMMARY OF THE INVENTION

In view of the foregoing disadvantages, it is an object of an embodiment of the present invention to provide a fuel injection valve that generates smaller fuel spray particles and permits the valve to be tightly closed and readily assembled by press-fitting. Another object of an embodiment of the present invention is to prevent excessive stresses from being subjected to the valve portion to prevent the sleeve from rotating.

According to a first aspect of the invention, a fluid injection valve includes an injection hole plate provided at a fluid path outlet formed at a tip portion of an end of a valve body, the plate having a plurality of injection holes. Furthermore, a sleeve is fixed to the valve body provided with the injection hole plate. The fluid injection valve injects fluid from the injection holes to control the amount of the fluid and determine the injection direction. The valve body has a bottom wall portion with a valve seat against/from which a valve member abuts/moves away, and a side wall portion provided upright from a peripheral edge of the bottom wall portion that supports the valve member in a reciprocating manner.

The injection hole plate is formed as a cup shape, has its entire circumference joined to the valve body to cover the fuel path, and has a bottom portion with the injection holes to allow the fuel path to communicate with an area outside of the valve structure. There is also a cylindrical portion provided upright from a peripheral edge of the bottom portion and press-fitted onto the side wall portion. The sleeve is a resin sleeve having a resin annular portion with an opening opened toward the downstream side of the fuel injected from the injection hole plate, and a resin cylindrical portion provided upright from a peripheral edge of the resin annular portion and press-fitted onto the side wall portion. One of the sleeve and the injection hole plate has a projection and the other has a cutout groove corresponding to the projection so that the sleeve and the injection hole plate may engage each other.

In general, in a resin sleeve having an opening opened toward the downstream side of fuel injected from the injection hole plate, its holding strength, kept fittingly fixed to the valve body, may be lessened depending upon the state of any high temperature creep as it is press-fitted onto the side wall of the valve body. This could cause the engagement of the sleeve to the outer periphery of the valve body to become undone. Additionally, in order to provide holding strength by press-fitting, excessive compressive stress could be induced into the valve body. Then, the valve may not be able to close as tightly as required in a fully closed state depending upon how much additional pressing force is provided to the sleeve to compensate for the decrease in the holding strength caused by the high temperature creep.

In contrast, in the fuel injection valve according to the invention, one of the sleeve and the injection hole plate has a projection and the other has a cutout groove corresponding to the projection so that the sleeve and the injection hole plate may engage each other. Therefore, without increasing the force of press-fitting the sleeve to compensate for the decrease in the holding strength due to any high temperature creep as in the conventional manner, the outer circumference of the valve body and the sleeve can securely be engaged with each other and the sleeve can be prevented from rotating.

Therefore, the valve tightness in a fully closed state can be secured, while the valve body and the sleeve can be engaged without increasing the force of press-fitting the sleeve. The valve body and the sleeve can more readily be assembled by press-fitting.

According to a second aspect of the invention, in providing the projection to the injection hole plate and the cutout groove corresponding to the projection, to the sleeve, the resin cylindrical portion, press-fitted onto the side wall portion, includes a press-fitting portion that can be press-fitted onto the side wall portion at an axial end. The cutout groove having a shape that engages with the projection is provided at the inner circumference between the press-fitting portion and the annular resin portion. The cylindrical portion press-fitted onto the side wall portion is provided with the projection, corresponding to the cutout groove, at the outer circumference of the cylindrical portion.

More specifically, a press-fitting portion that can be press-fit onto the side wall portion is provided at an axial end of the resin cylindrical portion of the sleeve. The cutout groove having a shape that engages with the projection is provided at the inner circumference of the sleeve between the press-fitting portion and the resin annular portion. The inner circumference of the cylindrical portion of the injection hole plate is press-fit onto the side wall portion and the projection corresponding to the cutout groove is provided at the outer circumference of the cylindrical portion. In this way, without increasing the force of press-fitting the sleeve, the valve body and the sleeve can more easily engage each other.

According to a third aspect of the invention, in addition to providing the projection of the cylindrical portion of the injection hole plate which corresponds to the cutout groove of the sleeve, a press-fitting portion that can be press-fitted onto the side wall portion at an axial end of the sleeve and the valve body is provided. The projection is provided at the inner circumference of the sleeve between the press-fitting portion and the resin annular portion. The cylindrical portion press-fitted onto the side wall portion is provided with the cutout groove having a shape that engages the projection at the outer circumference of the cylindrical portion.

More specifically, in addition to a cutout groove corresponding to a projection provided, a press-fitting portion that can be press-fitted onto the side wall portion is provided at an axial end of the resin cylindrical portion of the sleeve. The projection is provided at the inner circumference between the press-fitting portion and the resin annular portion. The inner circumference of the cylindrical portion of the injection hole plate is press-fitted onto the side wall portion and the cutout groove corresponding to the projection is provided at the outer circumference of the cylindrical portion of the injection hole plate. In this way, without increasing the force of press-fitting the sleeve, the outer periphery of the valve body and the sleeve can more securely engage each other.

Note that the cutout groove is provided adjacent to the cylindrical portion and press-fit onto the side wall portion. Therefore the rigidity of the cylindrical portion can be reduced because of the cutout groove. Therefore, the strength for holding the injection hole plate press-fitted onto the side wall portion of the valve body may be reduced. In this way, the inner circumference of the valve body is deformed less by the press fitting that affects the valve tightness in a fully closed state. Therefore, the valve tightness in a fully closed state can be improved.

According to a fourth aspect of the invention, the press-fitting portion is provided at approximately an equal pitch at the inner circumference of the resin cylindrical portion, and the projection and the press-fitting portion are arranged so that their circumferential positions do not overlap. More specifically, in the resin sleeve, the press-fitting portion press-fitted to the valve body, is provided at about an equal pitch at the inner circumference of the resin cylindrical portion. Additionally, the projection and the press-fitting portion are arranged so that their circumferential positions do not overlap. In this way, the projection formed at the inner circumference of the sleeve and the press-fitting portion are arranged so that their circumferential positions do not overlap or coincide. Therefore, the sleeve can more readily be resin-molded.

According to a fifth aspect of the invention, an annular rib is formed at the axial end of the cylindrical portion, and the cutout groove provided adjacent to the cylindrical portion is provided at the rib. More specifically, the annular rib is formed at the axial end of the cylindrical portion of the injection hole plate that is formed into a cup shape. The cutout groove is provided at the rib, and therefore such a cutout does not have to be provided during press-working of the cup-shaped injection hole plate into the developed form. The injection hole plate in the developed form is subjected to deep-drawing and formed into a cup shape followed by press punching to the thin plate member. At that time, the cutout groove can be formed at the annular rib. Therefore, when the injection hole plate is subjected to deep drawing, the injection hole plate does not have a cutout groove that might lower the rigidity of the injection hole plate in the developed form, and the injection hole plate can readily be produced.

According to a sixth aspect of the invention, the projection provided at the cylindrical portion is made of a rib extending in the radial direction from the axial end of the cylindrical portion of the injection hole plate. In this way, similarly to the fifth aspect, the injection hole plate can more readily be provided with the projection.

According to a seventh aspect of the invention, the opening has an approximately elliptical shape. Generally, when the opening of the sleeve opened to the downstream side of the fuel injected from the injection hole plate has approximately an elliptical shape, the distance from the outlets of the injection holes formed at the lower surface of the injection hole plate to the inner circumference of the opening portion may vary depending upon the circumferential positions where the sleeve is engaged with the valve body or the injection hole plate. Therefore, when the fuel injection valve has an opening of this kind, fuel injected from injection holes could interfere with the inner circumference of the opening depending upon the circumferential position where the sleeve is engaged with the injection hole plate.

In contrast, in the fuel injection valve according to the present invention, when the sleeve and injection hole plate are press-fitted onto the valve body for assembly, either the sleeve or the injection hole plate is provided with projections, and the other is provided with the cutout grooves corresponding to the projections, so that they may engaged each other. Therefore, the engagement between the injection hole plate and the sleeve around their circumferential interface is not undone. Therefore, injected fuel does not interfere with the inner circumference of the opening by shifts caused in the assembled state between the injection hole plate and the sleeve.

According to an eighth aspect of the invention, the injection holes are preferably arranged annularly and are not symmetrical with respect to the fuel injection valve axis, but line-symmetrical on the injection hole plate, such that axial lines of the injection holes radially extend toward the downstream side with respect to the axial direction of the fuel injection valve.

According to a ninth aspect of the invention, a fuel injection valve includes a valve body provided with a valve seat at an inner wall surface of the valve body. A fluid path is formed and a valve member seating at the valve seat opens and closes the fluid path adjacent an injection hole plate attached to the valve body on the fluid downstream side of the valve member. The injection hole plate has a plurality of injection holes and a cup-shaped sleeve is attached to the valve body to cover the outer circumference of the injection hole plate.

The fuel injection valve injects fuel from the injection holes. The sleeve has an opening from which fuel injected from the injection holes is discharged. One of the sleeve and the injection hole plate is provided with a projection, while the other is provided with a cutout groove corresponding to the projection, so that the sleeve and the injection hole plate may engage with each other. In this way, if the sleeve is allowed to rotate, the inner circumferential surface of the cutout groove abuts against the outer circumferential surface of the projection, and therefore excessive stress upon the valve portion can be prevented as much as possible while the sleeve can be prevented from rotating.

According to a tenth aspect of the invention, a plurality of the projections and the cutout grooves are provided around the outer circumference of the cylindrical portion of the injection hole plate and the inner circumference of the sleeve. Therefore, a plurality of fitting portions are provided, and the sleeve can be prevented from rotating.

According to an eleventh aspect of the invention, the sleeve is provided with a projection projecting radially inward at the inner circumferential surface of the sleeve, and the injection hole plate is provided with a cutout groove engaged with the projection at the outer circumferential surface of the injection hole plate.

According to a twelfth aspect of the invention, the present invention may preferably be applied to the fuel injection valve with an opening formed into an approximately elliptical shape. Alternatively, according to a thirteenth and fourteenth aspect of the invention, there may be a negative pressure generating portion for generating negative pressure by flowing fuel from the opening to draw fuel adhering to the sleeve outer circumferential surface.

The injection valve spray characteristics can be degraded if the sleeve rotates. Meanwhile, in the fuel injection valve according to twelfth to fourteenth aspects of the invention, the sleeve can be prevented from rotating and therefore the advantages are significant.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Fuel injection valves according to embodiments of the present invention will now be described in conjunction with the accompanying drawings.

[First Embodiment]

Figure 1:
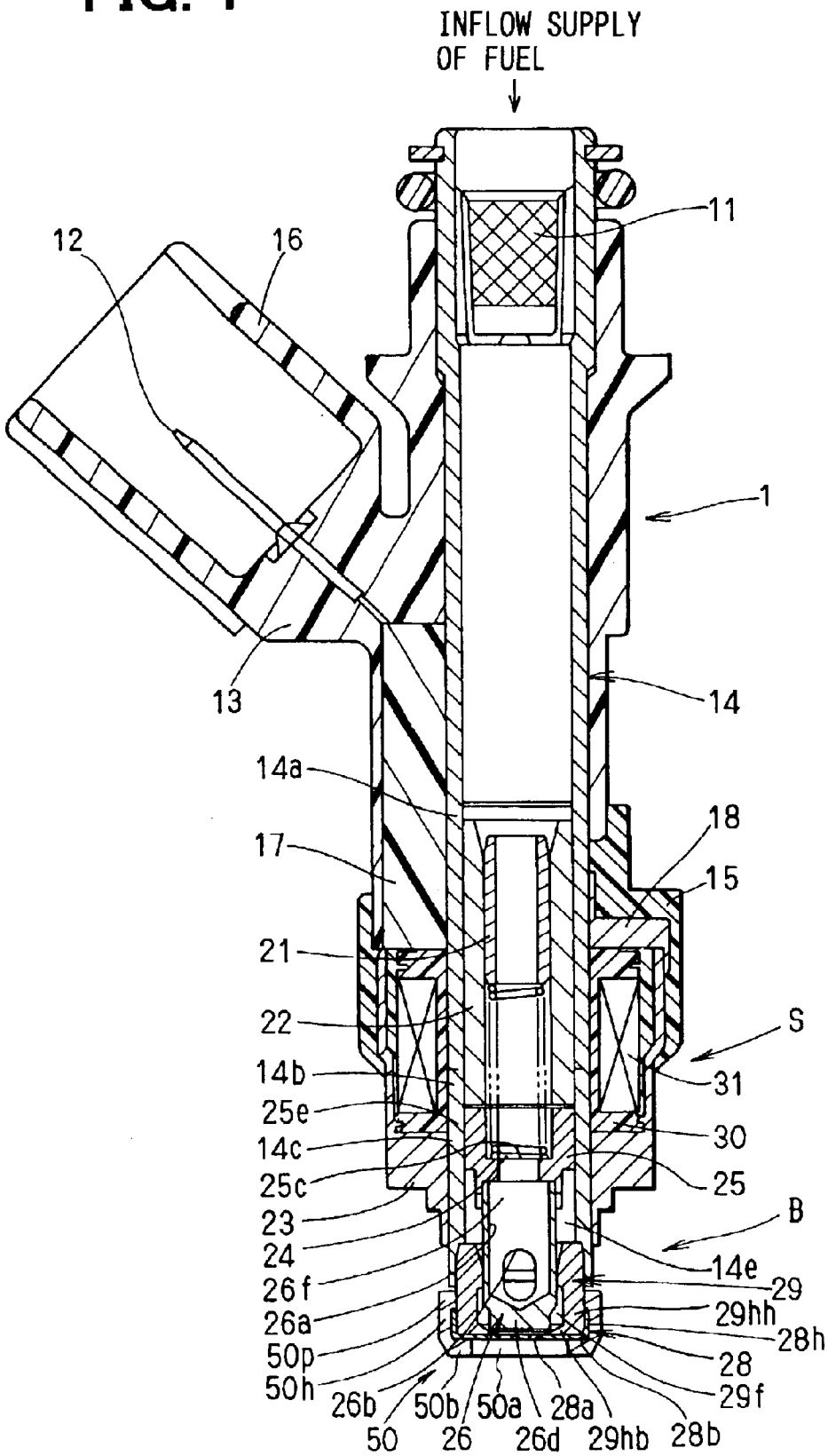
FIG. 1 is a cross-sectional view showing a fuel injection valve structure according to a first embodiment of the invention.
Figure 2:
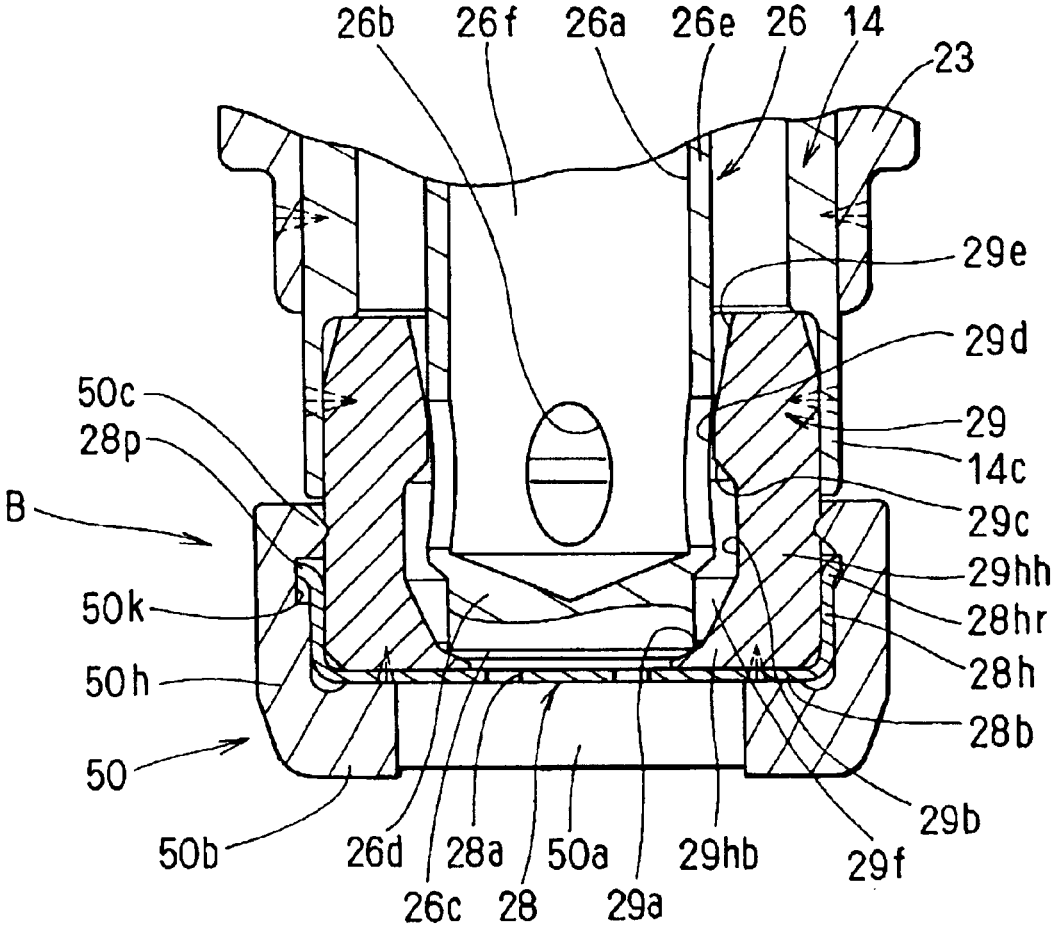
FIG. 2 is a cross-sectional view of valve portion B of FIG. 1 according to a first embodiment of the invention.
Figure 3A:
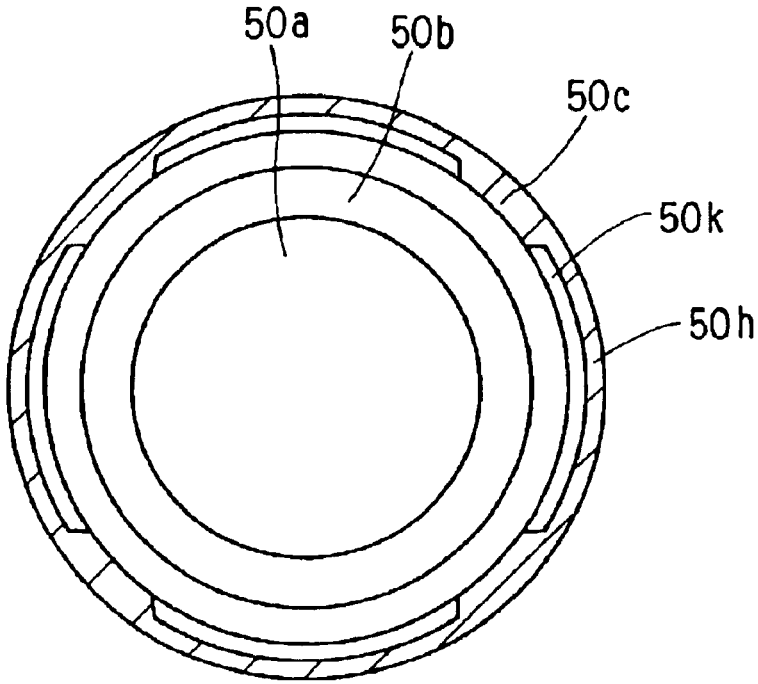
FIG. 3A is a transverse cross-sectional view of a sleeve of FIG. 2 taken along line 3A—3A in FIG. 3B.
Figure 3B:
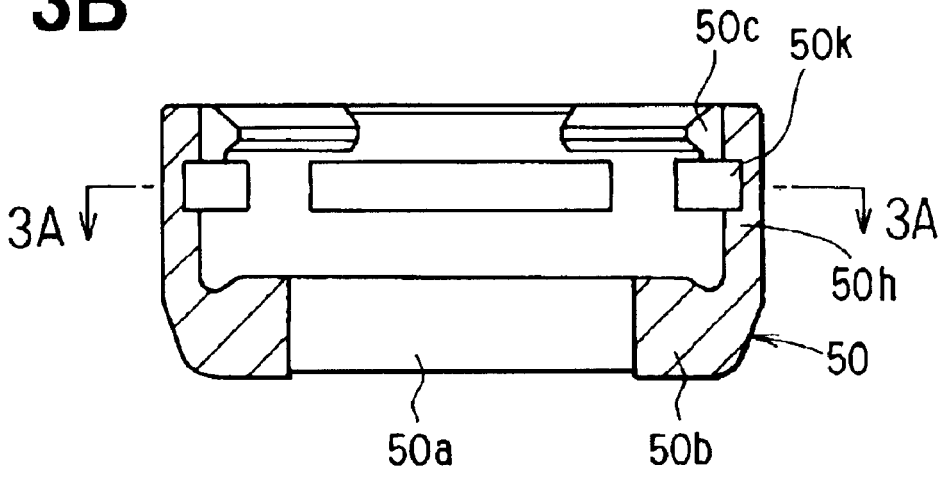
FIG. 3B is a transverse cross-sectional view of a sleeve of FIG. 2.
Figure 4:
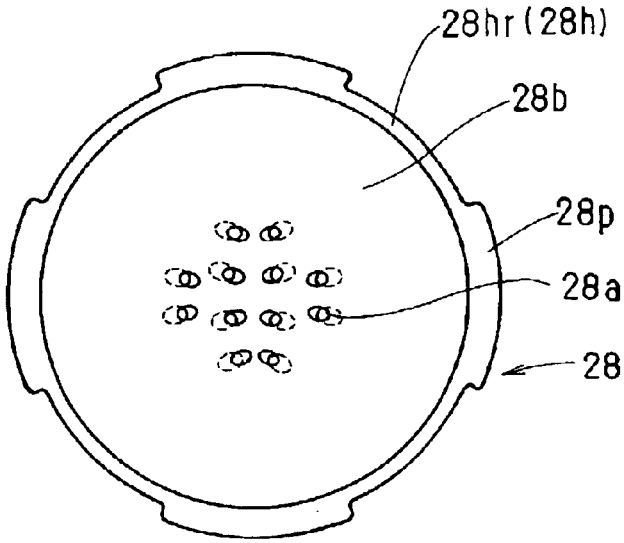
FIG. 4 is a plan view of an injection hole plate of FIG. particularly showing the projection structures.

FIG. 1 is a cross-sectional view of a fuel injection valve according to an embodiment of the present invention showing the general structure of the valve 1. FIG. 2 is a cross-sectional view of the end portion of the valve in FIG. 1. FIGS. 3A and 3B are cross-sectional views of the sleeve in FIG. 2. FIG. 3A is a transverse cross-sectional view taken along line 3A—3A in FIG. 3B, and FIG. 3B is a vertical cross-sectional view of the sleeve shown in FIG. 2. FIG. 4 is a plan view of an injection hole plate in FIG. 2, particularly showing the structure of a plurality of projections.

FIGS. 1 and 2 show a fuel injection valve 1 that is typically used in an internal combustion engine. Generally, the fuel injection valve 1 is attached to the suction pipe of an internal combustion engine for injecting fuel, so that the fuel is supplied to the combustion chamber of the internal combustion engine. The fuel injection valve 1 is approximately cylindrical, and includes a valve body 29 and a valve member (hereinafter referred to as "nozzle needle") 26 as a valve portion B, a coil 31, a cylindrical member 14, an armature 25, and a compression spring 24. The coil 31 is wound around a spool 30 which serves as an electromagnetic driving portion S. The cylindrical member 14 forms a magnetic circuit through which a flux passes. The flux passes by an electromagnetic force caused by energizing the coil 31. The armature 25 can axially be moved by the suction force caused by the flux. The compression spring 24 biases the armature 25 toward the valve body 29 so that the nozzle needle 26 abuts against the valve body 29 and closes the valve when no current is passed across the coil 31.

The valve body 29 and the nozzle needle 26 as the valve portion B will now be described.

The valve body 29 is fixed to the inner wall of the cylindrical member 14 by welding. More specifically, as shown in FIG. 2, the valve body 29 can be press-fitted or inserted in the magnetic tube portion 14*c* of the cylindrical member 14. The valve body 29 inserted to the inner wall of the magnetic tube portion 14*c* is welded along the entire outer circumference from the outer circumference side of the magnetic tube portion 14*c*.

A valve seat 29*a* is formed on the inner circumferential side of the valve body 29. The nozzle needle 26 abuts against and moves away from the valve seat 29*a*. More specifically, as shown in FIG. 2, a fuel path for fuel injected into the internal combustion engine is formed on the inner circumferential side of the valve body 29. With respect to fuel flow, from a most downstream location closest to an internal combustion engine to an upstream location, a conical slope surface 29*a* as a valve seat, a large diameter cylindrical wall surface 29*b*, a conical slope surface 29*c*, a small diameter cylindrical wall surface 29*d*, and a conical slant surface 29*e* are formed in such an order.

The small diameter cylindrical wall surface 29*d* supports the nozzle needle 26 in a slidable manner. The conical slant surface or valve seat 29*a* has its diameter reduced in the fuel injection direction. The abutment portion 26*c* of the nozzle needle 26 abuts against and moves away from the seat, so that the abutment portion 26*c* and valve seat 29*a* can seat. In this way, the valve portion can open or close to communicate and interrupt the passage of injected fuel. The large diameter cylindrical wall surface 29*b* forms a fuel pool chamber 29*f* together with the fuel pool hole, i.e. the nozzle needle 26. The small diameter cylindrical wall surface 29*d* forms a needle support hole that supports the nozzle needle 26 in a slidable manner. The needle support hole formed by the small cylindrical wall surface 29*d* has a diameter smaller than that of the fuel pool hole formed by the large diameter cylindrical wall surface 29*b*. Note that the conical slant surface 29*e* has its diameter enlarged in an upstream fuel direction.

Note that the valve seat 29*a*, the large diameter cylindrical wall surface 29*b*, the conical slope surface 29*c*, the small diameter cylindrical wall surface 29*d*, the conical slant surface 29*e* and the inner circumference of the cylindrical member 14 form a guide hole that accommodates the nozzle needle 26.

Note that the valve body 29 includes a bottom wall portion 29*hb* having the valve seat 29*a* against/from which the nozzle needle 26 abuts/moves away, and a side wall portion 29*hh* provided upright from the periphery of the bottom wall portion 29*hb*. The nozzle needle 26 is supported by the side wall portion 29*hh* in such a manner that the needle 26 can reciprocate.

The nozzle needle 26 is a valve member having a cylindrical body and a bottom. The nozzle needle 26 can be stainless steel. The abutment portion 26*c* that can abut against and move away from the valve seat 29*a* is formed at the tip end of the nozzle needle 26. More specifically, as shown in FIG. 2, the nozzle needle 26 includes a small diameter columnar portion 26*d* and a large diameter columnar portion 26*e*. The small diameter columnar portion 26*d* is a columnar body whose tip end portion or whose fuel injection side has a smaller diameter than the fuel upstream side. The large columnar portion 26*e* is slidably supported at the inner circumference of the valve body 29, more specifically, at the small diameter cylindrical wall surface 29*d*.

The end surface of the small diameter columnar portion 26*d* on the fuel injection side is chamfered to form a conical slant surface, or the abutment portion 26*c*. In this way, the diameter of the abutment portion 26*c*, in other words the seat diameter, is smaller than that of the needle support hole at the small diameter cylindrical wall surface 29*d*. Therefore, the valve seat 29*a* can readily and precisely be processed, while at the same time, the valve seat 29*a* and the abutment portion 26*c* can maintain tight contacts when they are abutted against each other in a full valve closed state. More specifically, the seat diameter is smaller than that of the needle support hole formed by the small diameter cylindrical wall surface 29*d* of the valve body 29.

Therefore, the small diameter cylindrical wall surface 29*d*, the conical slope surface 29*c*, and the large diameter cylindrical wall surface 29*b* as the inner circumference of the valve body 29 and the valve seat 29*a* are formed by cutting. Then, when a cutting tool is inserted to the fuel pool chamber 29*f* from the fuel upstream side, the seat portion of the valve seat 29*a* can readily and precisely be processed so that the valve can tightly be kept closed.

Meanwhile, the large diameter columnar portion 26*e* is provided on the fuel upstream side of the nozzle needle 26, and has a columnar shape having an outer diameter slightly smaller than the inner diameter of the small diameter cylindrical wall surface 29*d*, so that the valve body 29 can slidably be accommodated by the small diameter cylindrical wall surface 29*d*. In this way, a prescribed small gap is formed between the outer circumferential wall surface of the large diameter columnar portion 26*e* and the small diameter cylindrical wall surface 29*d*, so that these surfaces can slidably contact each other.

A major part of the large diameter columnar body 26*e* is formed into a thin cylindrical shape. As shown in FIG. 2, there is an internal path 26*f* for fuel directed downstream on the fuel injecting side at the inner circumferential wall surface 26*a*. The internal path 26*f* is formed by perforating the end surface of the large diameter columnar portion 26*e* on the upstream side of the fuel. The depth of perforation is set so that the bottom of the nozzle needle 26 can withstand an impact such as when the abutment portion 26*c* seats on the valve seat 29*a*. In this way, the nozzle needle 26 can be reduced in weight while its strength against the impact generated upon abutting against the valve seat 29*a* can be secured.

Note that on the downstream side of the internal path of the large diameter columnar portion 26*e*, there is at least one outlet hole 26*b* on the downstream side in communication with the valve seat 29*a*, or the fuel pool chamber 29*f*. The injection hole plate 28 is a thin plate provided at the tip end side of the fuel injection valve 1 and has a plurality of injection holes 28*a* in the center. The injection direction from the injection holes 28*a* can be determined by the injection hole axial line and the arrangement of the injection holes. The amount of fuel to be ejected from the injection holes can be adjusted depending on the area of the injection hole opening and how long the valve portion is opened by an electromagnetic driving portion.

At the outer circumferential side of the injection hole plate 28, a sleeve 50 serving as a protection member is fixed, in order to prevent the inner wall of the suction pipe and the fuel injection valve 1 from contacting and damaging the injection holes 28*a* when the fuel injection valve 1 is attached to the suction pipe of the internal combustion engine. More specifically, the sleeve 50 is made of a resin material, and is press-fit onto the outer circumferential side surface of the injection hole plate or the valve body 29. The frictional force of the press fitting stops the rotation of the sleeve 50 with respect to the valve body 29 and the injection hole plate 28. Note that the valve portion B as the tip end of the fuel injection valve 1, particularly the periphery of the injection hole plate 28 and the sleeve 50 will later be described in detail.

The coil 31, the cylindrical member 14, the armature 25, the compression spring 24 and other parts serving as the electromagnetic driving portion S will now be described. Note that the electromagnetic driving portion S may be any mechanism that opens and closes the valve portion of the fuel injection valve 1 by allowing and interrupting energization.

As shown in FIG. 1, the coil 31 is wound around the outer periphery of the resin spool 30 and there is a terminal 12 electrically connected to the end of the coil 31. Note that the spool 30 is mounted at the outer circumference of the cylindrical member 14. A connector portion 16 is provided to project from the outer wall of a resin mold 13 formed at the outer circumference of the cylindrical member 14. The terminal 12 is embedded into the connector portion 16.

The cylindrical member 14 is a pipe member including magnetic and non-magnetic portions, and made of, for example, a composite magnetic material. The cylindrical member 14 is partly heated to make it non-magnetic, so that the cylindrical member 14 shown in FIG. 1 has a magnetic tube portion 14*c*, a non-magnetic tube portion 14*b*, and a magnetic tube portion 14*a*, in this order, from the lower fuel injection side to the upstream side. Note that an armature accommodation hole 14*e* is formed at the inner circumference of the cylindrical member 14, and the armature 25 is accommodated in the vicinity of the boundary between the non-magnetic tube portion 14*b* and the magnetic tube portion 14*c*.

The cylindrical member 14 forms a magnetic circuit through which a flux by electromagnetic force generated by energizing the coil 31 is passed. As shown in FIG. 1, at the outer periphery of the cylindrical member 14, a magnetic member 23, a resin mold 15, and a magnetic member 18 are provided. More specifically, the magnetic member 23 covers the outer periphery of the coil 31, and the magnetic member 18 is provided, for example, in a sector shape on the fuel upstream side of the coil 31 to be kept away from a rib 17. The resin mold 15 is formed at the outer periphery of the magnetic members 18 and 23, and coupled with the resin mold 13.

In this way, the magnetic flux formed by electromagnetic force generated by energizing the coil 31 forms a magnetic circuit through the magnetic tube portion 14*a*, the suction member 22, the armature 25, the magnetic tube portion 14*c*, the magnetic member 23, and the magnetic member 18, in such an order.

The armature 25 is a stepped tubular body made of a ferromagnetic material such as magnetic stainless steel and fixed to the nozzle needle 26. In this way, when the coil 31 is energized, the flux by the electromagnetic force generated at the coil 31 acts upon the armature 25 through the suction member 22. In this way, the armature 25 as well as the nozzle needle 26 can be moved in the axial direction on the side of the suction member 22 or in the direction away from the valve seat 29*a*. The internal space 25*e* of the armature 25 is in communication with the internal path 26*f* of the nozzle needle 26.

The suction member 22 is a cylindrical body made of a ferromagnetic material such as magnetic stainless steel, press-fitted and fixed in the inner circumference of the cylindrical member 14. A biasing spring (hereinafter referred to as "compression spring") 24 is held between the end surface of an adjusting pipe 21 provided at the inner circumference of the suction member 22 and a spring seat 25*c* which is a stepped portion forming the internal space 25*e* of the armature 25. When the coil 31 is not energized, the armature 25 is biased toward the valve body 29 by a prescribed biasing force so that the nozzle needle 26, fixed to the armature 25, abuts against the valve body 29 to open the valve. More specifically, the abutment portion 26*c* abuts against the valve seat 29*a*.

Note that the adjusting pipe 21 is press-fitted and fixed in the inner circumference of the suction member 22, and the biasing force of the compression spring 24 can be adjusted to a prescribed level depending upon how much the adjusting pipe 21 is press-fit. Note that on the fuel injection side of the cylindrical member 14, the valve body 29 and the injection hole plate 28 are accommodated in a liquid-tight manner. The injection hole plate 28 is welded in a liquid-tight manner to the valve body 29, and the valve body 29 may be fixed to the cylindrical member 14 in a liquid-tight manner. Meanwhile, a filter 11 as shown in FIG. 1 is attached above the cylindrical member 14. The filter 11 removes foreign matter included in fuel coming from upstream of the fuel injection valve 1.

Here, the cylindrical member 14 is fixed in an oil-tight manner with the valve body 29. The valve body 29 forms a guide hole accommodating the nozzle needle 26, and is therefore a part of the valve body 29.

The operation of the fuel injection valve 1 as described above will now be described. When the coil 31 of the electromagnetic driving portion S is energized, an electromagnetic force is generated at the coil 31. At that time, a suction force to attract the armature 25 is generated at the suction member 22 in the armature 25 and the suction member 22 forming the magnetic circuit. This causes the nozzle needle 26 fixed to the armature 25 to move away from the valve seat 29*a* of the valve body 29. Therefore, the valve body 29 and the nozzle needle 26 are opened, so that fuel coming from the upstream side of the fuel injection valve 1 is injected into the internal combustion engine through the injection holes 28*a* via the armature accommodation hole 14*e*, the internal path 26*f* and the like.

Meanwhile, when the energization is interrupted, the electromagnetic force generated at the coil 31 disappears, so that the suction force attracting the armature 25 toward the suction member 22 disappears as well. Therefore, the compression spring 24 biasing the armature 25 presses the nozzle needle 26 in the abutting direction against the valve seat 29*a* of the valve body 29. Therefore, the valve body 29 and the nozzle needle 26 are closed, so that the fuel injected into the internal combustion engine is interrupted. At that time, when the valve portion B is tightly closed (more specifically, when the abutment portion 26*c* of the nozzle needle 26 and the valve seat 29*c* are abutted against each other in a tightly sealed state), the flow of the fuel can precisely be interrupted.

In this way, the energizing period, in other words, the valve open period, can be varied for the fuel injection valve 1, so that the amount of fuel injected into the internal combustion engine can be adjusted.

Meanwhile, the fuel injection valve 1 described above is precisely produced on an element basis. When, however, the elements are press-fitted or welded with each other and assembled into the fuel injection valve 1 in the manufacturing process, they could be deformed by the press-fitting or thermally distorted by the welding. This could affect the closed state, in other words the sealed state, and there could be a gap generated at the sealed part (more specifically, at the part between the valve seat 29*a* and the abutment portion 26*c* in abutment against each other when the valve portion B is closed).

Among the elements assembled into the peripheral part of the valve body B, the resin sleeve 50 is press-fitted onto the valve body 29 or the injection hole plate 28 and fixed. Depending upon the state of high temperature creep caused because the resin material is used, the holding strength of the sleeve can be lowered when the sleeve is press-fitted onto the outer peripheral side surface of the valve body 29 or injection hole plate 28. This could, for example, disengage the sleeve 50 from the outer periphery of the valve body 29. Meanwhile, in order to secure the holding strength by press-fitting, the valve tightness in the fully closed state can be impaired by excessive compressive stress given to the valve body 29 depending upon how much additional press-fitting force for the sleeve 50 is necessary to compensate for the decrease in the holding strength caused by the high temperature creep.

Additional Features and Their Detailed Description

According to the embodiment of the present invention, a fuel injection valve 1 has the following features and allows the fuel spray to have smaller particles and the valve tightness to be improved, while the valve can readily be assembled by press-fitting.

Now, the fuel injection valve 1 according to the embodiment (see FIGS. 1 and 2) addresses the following points in connection with improvements in the valve tightness. When the elements are press-fitted for assembly, the valve tightness can be improved, in other words, fuel leakage in the valve fully closed state can be minimized. Therefore, the embodiment of the invention can be applied to any conventional fuel injection valve that is assembled by press-fitting of the elements, particularly the valve portion, so that improvements in the valve tightness and the assembling by press-fitting can effectively be achieved.

Note that one of the points in connection with improvements in the valve tightness in the fuel injection valve 1 in FIGS. 1 and 2 is to reduce the weight of the nozzle needle 26 in order to improve the response of the valve opening and closing. Doing so will permit quick interruption of the fuel supply when the valve is fully closed (more specifically, to form the large diameter columnar portion 26*e* into a thin cylindrical body with a bottom). Another point is to provide foreign matter removing means in the cylindrical member 14 at a position where fuel enters the fuel injection valve 1. This may simply be a filter 11 mounted on the upstream side of the cylindrical member 14 in order to secure the valve tightness against foreign matter in fuel that might come into the fuel injection valve 1 when the valve is fully closed.

The valve portion B as the tip end of the fuel injection valve 1, particularly the periphery of the injection hole plate 28 and the sleeve 50 as portions of the embodiment, will now be described in conjunction with FIGS. 2, 3A, 3B and 4. The injection hole plate 28, for example, made of a stainless steel plate is formed into a cylindrical cup shape having a bottom. The injection hole plate 28 includes an approximately disc-shaped bottom portion 28*b* and a cylindrical portion 28*h* press-fitted onto the side wall portion 29*hh*. The cylindrical portion 28*h* is provided upright from the peripheral edge of the bottom portion 28*b*. The bottom portion 28*b* has a plurality of injection holes 28*a* in its center area.

The sleeve 50 includes a resin annular portion 50*b* having an opening 50*a* opened toward the downstream side of fuel injected from the injection hole plate 28, more specifically, the injection holes 28*a*. A resin cylindrical portion 50*h* is provided upright from the peripheral edge of the resin annular portion 50*b* and is press-fitted onto the side wall portion 29*hh*. The opening 50*a* has an inner circumference whose diameter is enlarged toward the downstream side of the fuel injection direction. This accounts for spraying in order to prevent the fuel injected from the injection holes 28*a* from interfering with any valve structure. Additionally, the inner circumference is projected toward the downstream side of the fuel injected from the injection holes 28*a* so that the spray is not prevented from having fine particles by the air stream passing through the suction pipe of an internal combustion engine.

According to the embodiment as shown in FIG. 2, projections 28*p* (see FIG. 4) projecting radially outward from the spray holes are provided at the outer periphery of the injection hole plate 28. Cutout grooves 50*k* (see FIGS. 3A and 3B) corresponding to the projections 28*p* are provided at the inner circumference of the sleeve 50, so that they engage each other.

More specifically, as shown in FIGS. 2, 3A and 3B, the sleeve 50 includes a press-fitting portion 50*c* which can be press-fitted over the side wall portion 29*hh*. The projections 28*p* are fitted into the cutout grooves 50*k* which have a fitting shape to accommodate the projections 28*p*. The projections 28*p* are located between the press-fitting portions 50*c* and the resin annular portion 50*b*. Meanwhile, the injection hole plate 28 is provided with the projections 28*p*, which correspond to the cutout grooves 50*k*, at the outer periphery of the cylindrical portion 28*h* which is press-fitted over the side wall portion 29*hh*.

In this way, the fuel injection valve 1 according to the invention has the projections 28*p* located at the outer periphery of the injection hole plate 28, and the cutout grooves 50*k*, which correspond to the projections 28*p*, located at the inner circumference of the sleeve 50, so that they accommodate each other. Therefore, as compared to the holding strength provided by press-fitting the sleeve 50 over the valve body 29 or the injection hole plate 28 for fixing in the conventional case, the injection valve is affected to a lesser degree by high temperature creep. Therefore, without increasing the force of press-fitting the sleeve 50 to compensate for the decrease in the holding strength by the high temperature creep, the outer circumference of the valve body 29 (more precisely, the side wall portion 29*hh*) and the sleeve 50 can securely engage each other. This prevents the inner circumference of the valve body 29 from deforming by an increased press-fitting force of the conventional case. Therefore, as the valve tightness is secured in a fully closed state, the valve body 29 and the sleeve 50 can more securely engage each other. That is, the valve body 29 and the sleeve 50 can readily be press-fitted and assembled when the sleeve body 50 is press-fitted onto the valve portion B, particularly onto the valve body 29.

Note that the projection 28*p* is preferably provided radially at the outer circumference at the rib 28 hr which is provided at the outer circumferential end of the cylindrical portion 28*h* of the injection hole plate 28. In forming the injection hole plate 28, a thin stainless steel plate is subjected to press punching and a drawing process and formed into a cup shape. After drawing into a cup shape is carried out, the rib 28 hr is punched. When the rib 28 hr is formed, the projections 28*p* are punched at the same time, which makes it easier to form the injection hole plate 28 by press working. Therefore, the manufacturing step to provide the projections 28*p* to the injection hole plate 28 can be simplified.

As shown in FIGS. 3A and 3B, in the sleeve 50, the press-fitting portions 50*c* are provided at approximately an equal pitch at the inner circumference of the resin cylindrical portion 50*h*. The projections 28*p* and the cutout grooves 50*k*, to be fitted with the projections 28*p*, and the press-fitting portion 50*c* preferably will not overlap around the circumference when viewed from an axial end of the valve 1. In this way, when the sleeve 50 is press-fitted to the valve portion B, having the injection hole plate 28 fixed at the tip end of the valve body 29, the projections 28*p* that project radially outward from the injection hole plate 28, can be prevented from damaging the press-fitting portions 50*c* provided at the inner circumference of the sleeve 50. Therefore, assembly by press-fitting can readily be achieved.

[Second Embodiment]

Figure 5:
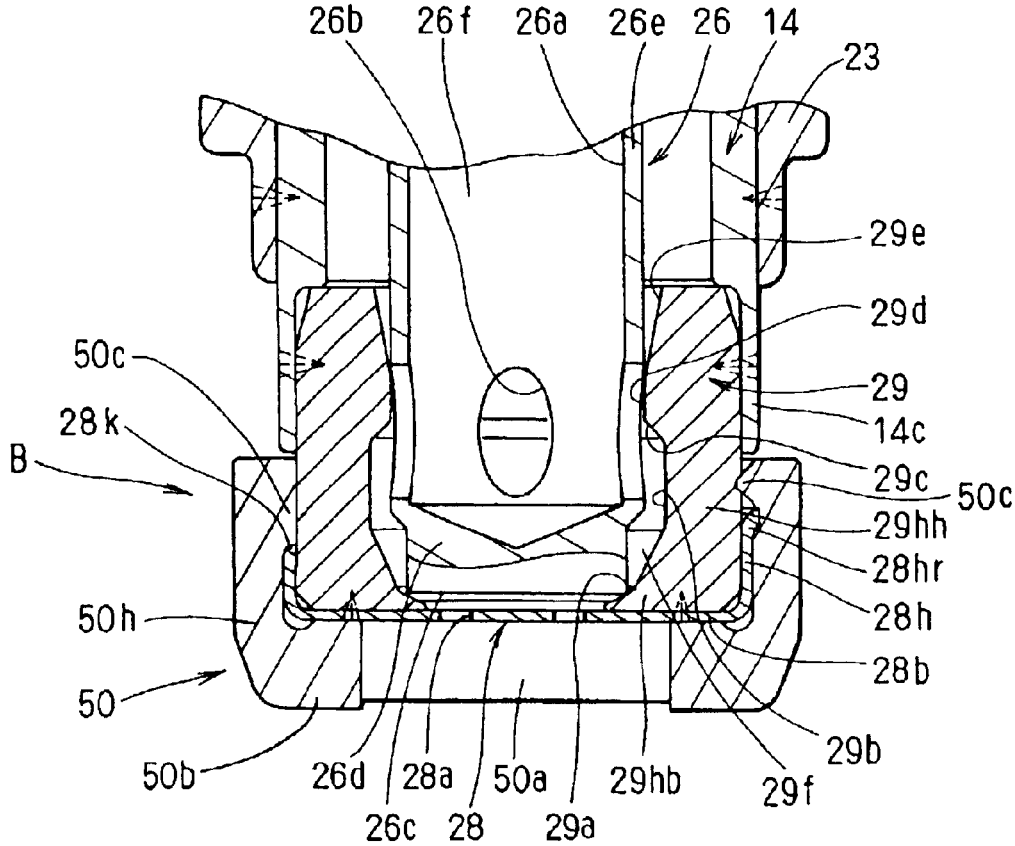
FIG. 5 is a cross-sectional view of the periphery of the valve portion of a fuel injection valve according to a second embodiment of the invention.
Figure 6A:
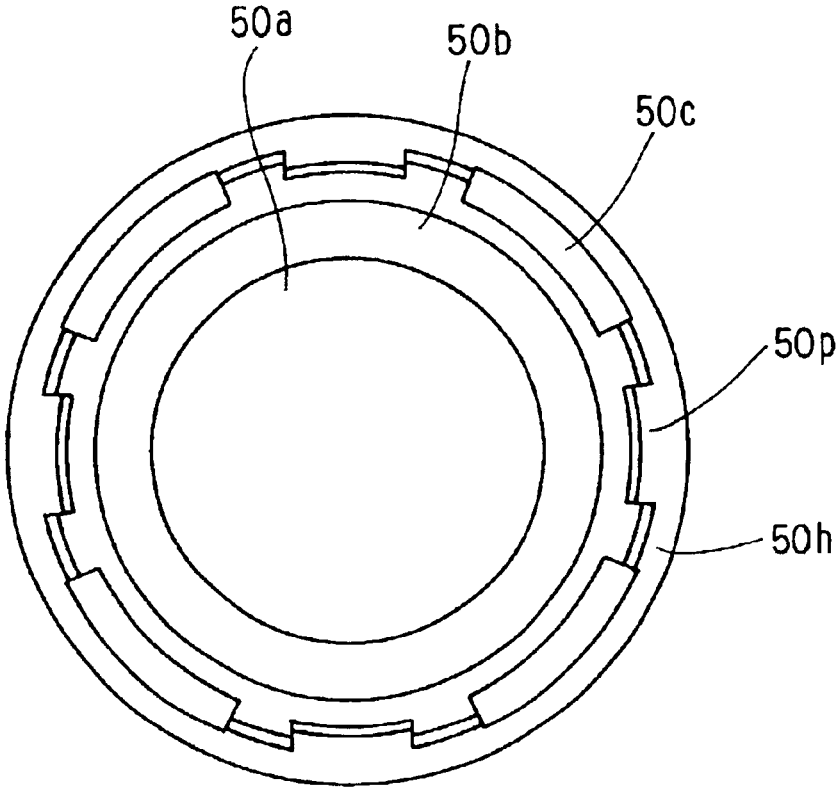
FIG. 6A is a plan view of the sleeve of FIG. 5.
Figure 6B:
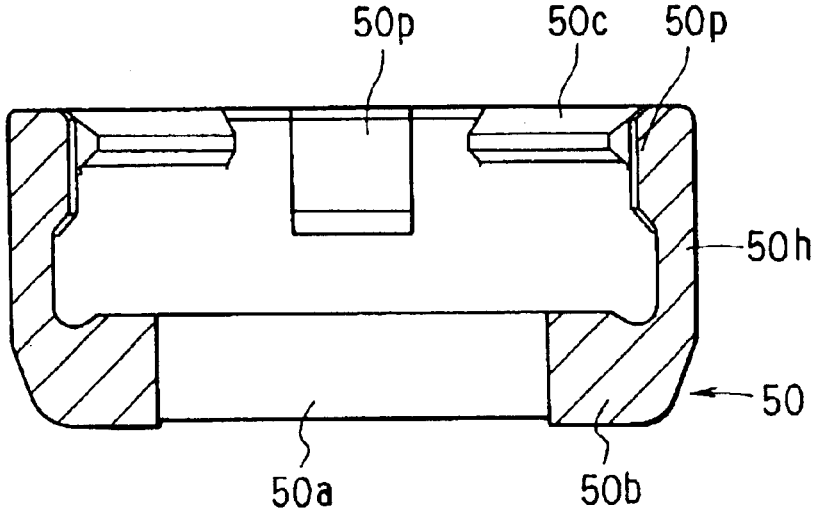
FIG. 6B is a cross-sectional view of the sleeve of FIG. 6A.
Figure 7A:
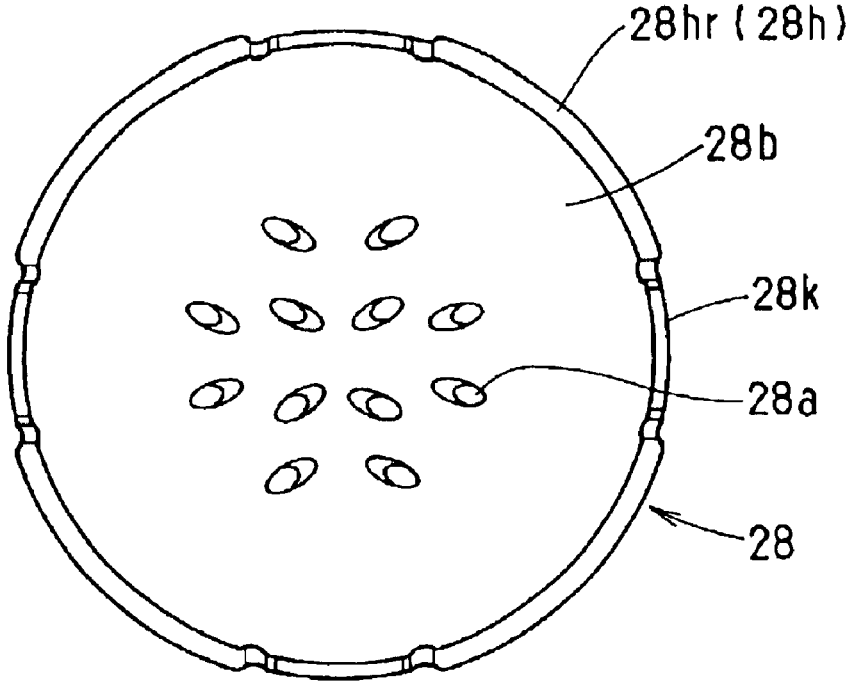
FIG. 7A is a plan view of the injection hole plate in FIG. 5.
Figure 7B:
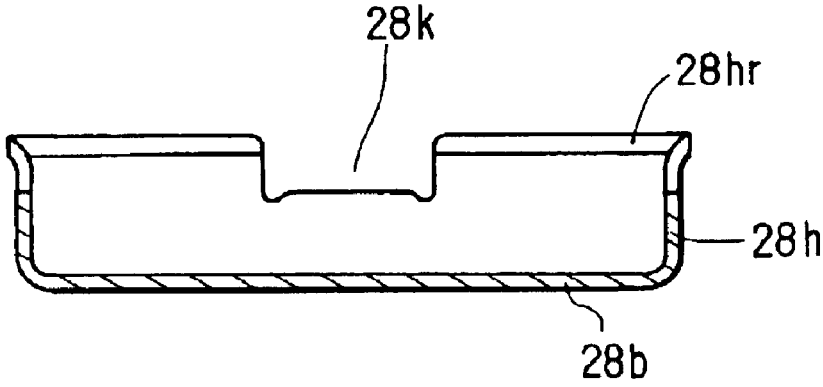
FIG. 7B is a cross-sectional view of the injection hole plate of FIG. 7A.

FIG. 5 is a cross-sectional view of the periphery of the valve portion of a fuel injection valve according to the second embodiment. FIG. 6A is a plan view of the sleeve in FIG. 5 and FIG. 6B is a cross-sectional view of the sleeve. FIG. 7A is a plan view of the injection hole plate in FIG. 5, and FIG. 7B is a cross-sectional view of the injection hole plate.

According to a second embodiment, the following elements are provided in place of the injection hole plate 28 having the projections 28*p*, and the sleeve 50 having the cutout grooves 50*k*, which have a shape corresponding to the projections 28*p*, according to the first embodiment. As shown in FIGS. 5 to 7, there is a sleeve 50 having projections 50*p* (FIGS. 6A and 6B) and an injection hole plate 28 having cutout grooves 28*k* (FIGS. 7A and 7B) that may engage with the projections 50*p*.

More specifically, as shown in FIGS. 5, 6A and 6B, the sleeve 50 includes a press-fitting portion 50*c* that can be press-fitted onto a side wall portion 29*hh* at the axial end of a resin cylindrical portion 50*h*. The projections 50*p* are provided at the inner circumference between the press-fitting portion 50*c* and a resin annular portion 50*b*. Additionally, the injection hole plate 28 is accommodated by the cutout grooves 28*k*, which has a shape that can be fitted to the projection 50*p* at the outer circumference of the cylindrical portion 28*h*, which is press-fitted onto the side wall portion 29*hh*. In this way, without increasing the press-fitting force of the sleeve 50 as in the conventional case, the outer circumference of the valve body 29 (more specifically, the side wall portion 29*hh*) and the sleeve 50 can securely engage, and the same effects as those of the first embodiment can be provided.

Note that the cutout grooves 28*k*, each having a shape that can engage the projection 50*p*, are provided adjacent the cylindrical portion 28*h* of the injection hole plate 28. The structure and hence, the rigidity, of the cylindrical portion 28*h* to be press-fitted onto the side wall portion 29*hh* can be reduced as a result, and therefore the strength of holding the injection hole plate 28 press-fitted onto the side wall portion 29*hh* of the valve body 29 may be reduced. In other words, the holding strength may be reduced. In this way, the inner circumference of the valve body 29 is less deformed by the press-fitting that affects the valve tightness in a fully closed state. Therefore, the valve tightness can be improved.

Note that as shown in FIGS. 6A and 6B, the press-fitting portions 50*c* are provided at about an equal pitch around the inner circumference of the resin cylindrical portion 50*h*, so that the projections 50*p* and the press-fitting portions 50*c* preferably do not overlap around the circumferential positions. In this way, the sleeve 50 can readily be resin-molded.

MODIFIED EXAMPLE

Figure 8A:
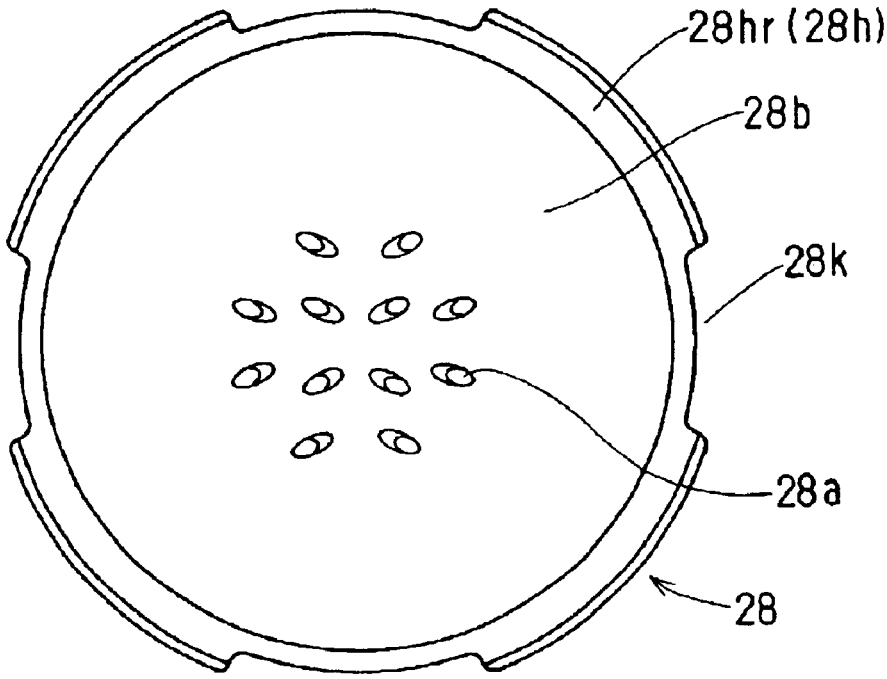
FIG. 8A is a plan view of the injection hole plate according to a modified example.
Figure 8B:
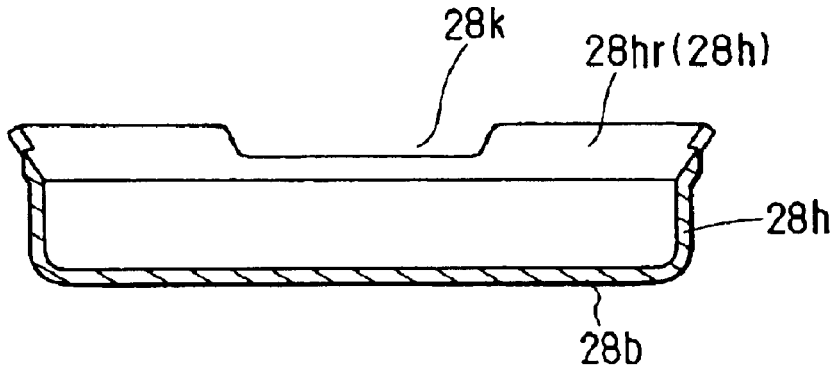
FIG. 8B is a cross-sectional view of the injection hole plate of FIG. 8A.

According to a modified example, as shown in FIGS. 8A and 8B, the cutout grooves 28*k* provided at the outer circumference of the cylindrical portion 28*h* of the injection hole plate 28, as described in conjunction with the second embodiment, may be provided at a rib 28 hr formed at the outer circumference of the cylindrical portion 28*h*. FIG. 8A is a plan view of the injection hole plate according to the modified example and FIG. 8B is a cross-sectional view of the injection hole plate.

In this way, when a thin stainless steel plate is punched and drawn into a cup shape in order to form the injection hole plate 28, after the drawing process, the cutout grooves 28*k* may be punched as the rib 28 hr is punched and molded. Therefore, the injection hole plate 28 can readily and easily be formed by press working. Additionally, the step of producing the cutout grooves 28*k* in the injection hole plate 28 is simplified.

Note that according to the embodiment, either the sleeve 50 or the injection hole plate 28 is provided with projections (50*p* or 28*p*), and the other is provided with the cutout grooves (28*k* or 50*k*) which engage the projections. The opening 50*a* of the sleeve 50 can be formed into a non-concentric circular shape, such as an approximate ellipse, as an example (see FIG. 10). Generally, when the opening 50*a* of the sleeve 50, opened to the downstream side of the fuel injected from the injection hole plate 28, is an approximate ellipse, the distance from the outlets of the injection holes 28*a* formed at the lower surface of the injection hole plate 28 to the inner circumference of the opening portion 50*a* could vary depending upon the circumferential position where the sleeve 50 engages with the valve body 29 or the injection hole plate 28. Therefore, when the fuel injection valve has the opening portion 50*a* of this kind, fuel injected from injection holes 28*a* could interfere with the inner circumference of the opening 50*a* depending upon the circumferential position where the sleeve 50 engages with the injection hole plate 28.

In contrast, in the fuel injection valve 1 according to the present invention, when the sleeve 50 and injection hole plate 28 are press-fitted onto the valve body 29 for attachment, either the sleeve 50 or the injection hole plate 28 is provided with projections (50*p* or 28*p*), and the other is provided with the cutout grooves (28*k* or 50*k*) corresponding to the projections, so that they may engage each other. Therefore, the engagement between the injection hole plate 28 and the sleeve 50 around the circumference will not become undone. Therefore, injected fuel does not interfere with the inner circumference of the opening portion 50*a* by shifts during the assembled state between the injection hole plate 28 and the sleeve 50.

Therefore, the fuel injection valve 1 according to the present invention is preferably applied as a fuel injection valve 1 having individual injection holes arranged in positions not symmetrical with respect to the fuel injection valve axis (see FIGS. 4, 7A, 7B, 8A and 8B). The invention is applicable, for example, to the case where the injection holes 28*a* are arranged in an annular fashion and the axial lines of the injection holes 28*a* radially extend toward the downstream side with respect to the axial direction of the fuel injection valve so as to provide symmetrical arrangement with respect to a line drawn on or parallel to the injection hole plate 28.

According to the embodiment, either the sleeve 50 or the injection hole plate 28 is provided with projections (50*p* or 28*p*), and the other is provided with the cutout grooves (28*k* or 50*k*) to engage the projections. In this structure, the cutout grooves (28*k* or 50*k*) having a shape that engages the projections (50*p* or 28*p*) need only be a groove that can prevent the circumferential engagement from becoming undone and the circumferential positions of the sleeve 50 and the injection hole plate 28 (more specifically, injection holes 28*a*) from being shifted from one another. In this way, the fuel injection valve 1 allows fuel spray to have finer particles and the valve to close more tightly. Finally, the valve can be assembled more readily by press-fitting.

[Third Embodiment]

Figure 9:
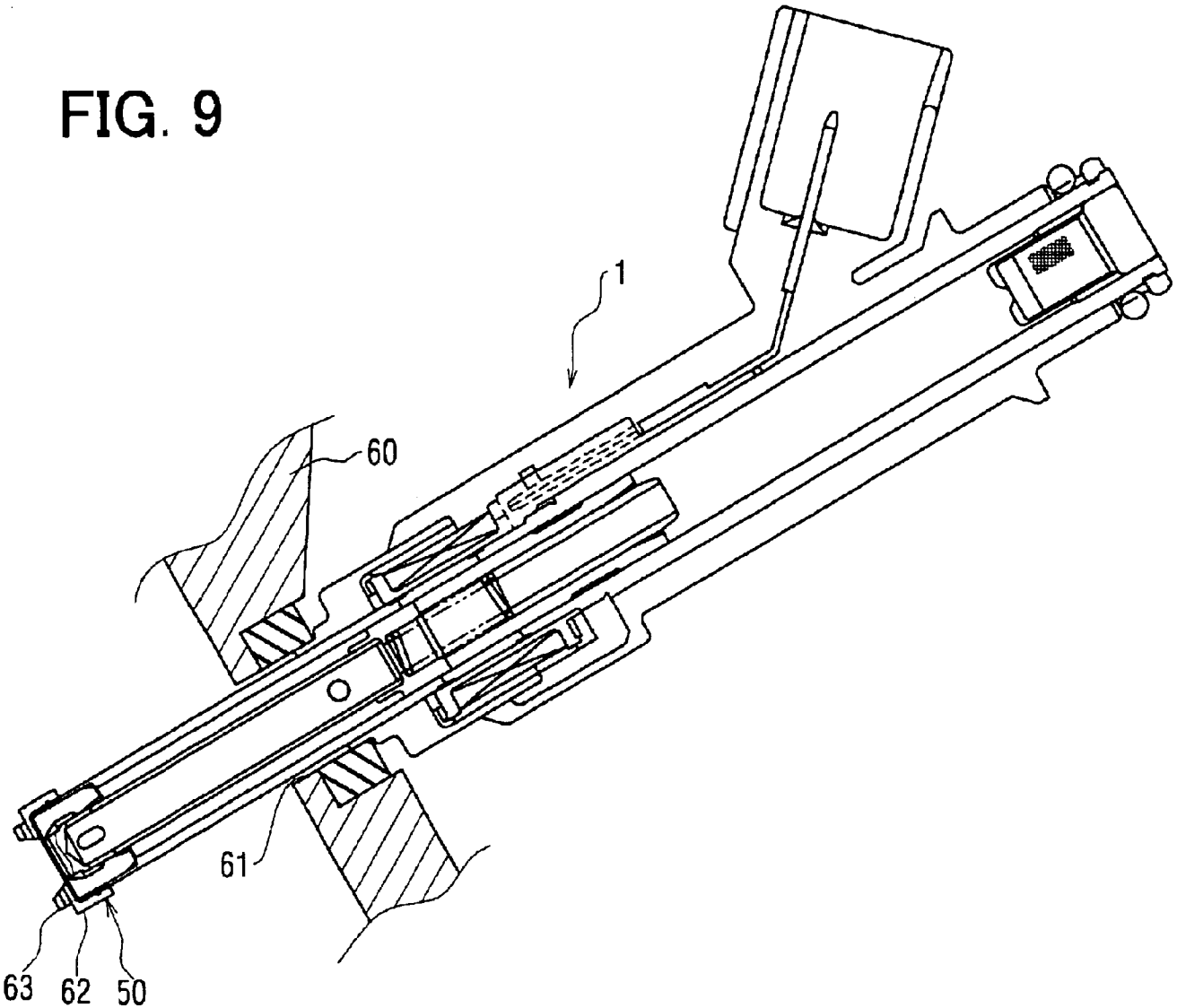
FIG. 9 is a view showing installation of a fuel injection valve according to a third embodiment of the invention.

A third embodiment of the present invention will now be described. As shown in FIG. 9, according to the embodiment, the inclined fuel injection valve 1 is attached to an opening 61 formed at a suction pipe 60.

Meanwhile, fuel injected from the injection holes 28*a* is discharged from the opening 50*a* of the sleeve 50 and delivered into the suction pipe 60. A considerable amount of the fuel may adhere to the outer circumferential surface of the sleeve 50. Particularly when the fuel injection valve 1 is inclined as in the embodiment, gravity acts upon it as well, and part 62, positioned on the lower side of the outer circumferential surface of the sleeve 50, especially may collect fuel.

Figure 10:
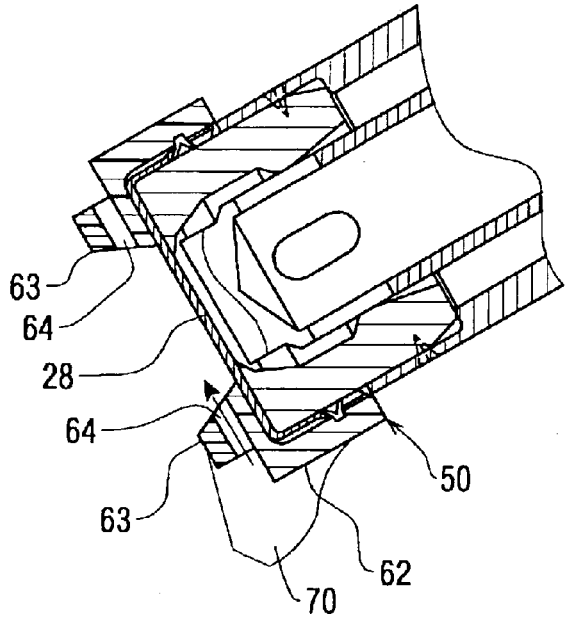
FIG. 10 is an enlarged view of an end portion of the fuel injection valve of FIG. 9.

Therefore, as shown in FIG. 10, according to the embodiment, fuel 70 sticking to the outer circumferential surface of the sleeve 50 is drawn by a negative pressure. More specifically, there are two raised portions 63 which oppose each other and are provided at the end of the sleeve 50 opposite to the injection hole plate to project in a direction away from the injection hole plate. The raised portions 63 each have a through hole 64 from the outer to inner circumferences of the raised portions.

The raised portion 63 has a trapezoidal section, and its outer circumferential surface is linearly formed so that it is perpendicular or approximately perpendicular to the plane of the end of the sleeve 50 opposite to the injection hole plate. The raised portion 63 has its inner circumferential surface tapered such that the distance between the raised portions 63 on the inner circumferential portion increases toward the downstream side of an injected fuel. When fuel is discharged from the opening 50*a*, a negative pressure is generated in the hole 64, and as denoted by the arrow in FIG. 10, the fuel 70 adhering to the outer circumferential surface of the sleeve 50 is drawn into the inner circumferential side of the raised portion 63 via the hole 64.

Figure 11A:
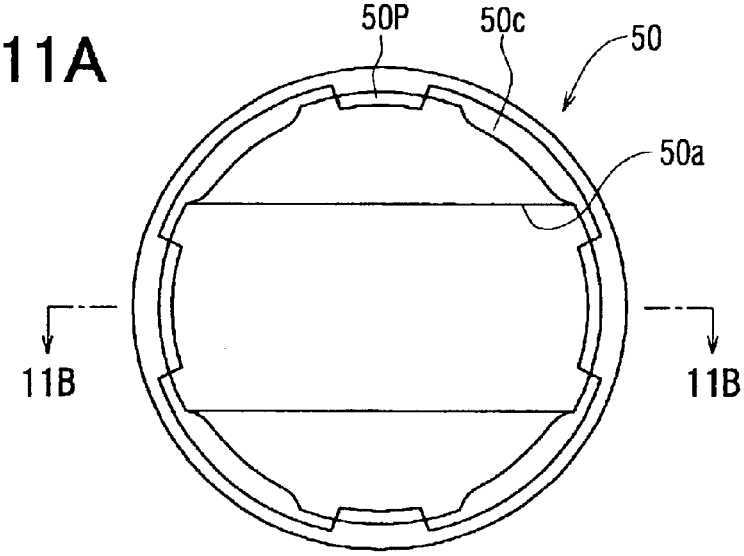
FIG. 11A is a plan view of a sleeve 50 when it is viewed from the fuel upstream side according to the third embodiment of the invention.
Figure 11B:
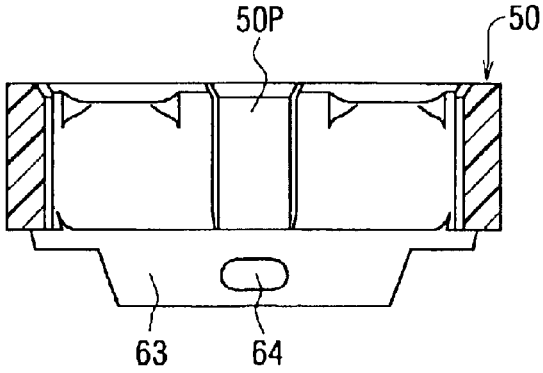
FIG. 11B is a cross-sectional view taken along line 11B—11B of FIG. 11A.

As shown in FIGS. 11A and 11B, according to the embodiment, the opening 50*a* of the sleeve 50 is formed into an approximately elliptical shape. If the sleeve 50 rotates and is circumferentially shifted from a desired position, the fuel spray characteristics are highly likely to become degraded.

More specifically, the distances from the outlets of the injection holes 28*a* to the inner circumference of the opening 50*a* could be different, and the fuel might interfere with the sleeve 50 in some cases. Note that the opening 50*a* of the sleeve 50 in a rectangular shape, for example, still experiences the same problem.

The raised portions 63 and holes 64 serving as the negative pressure generating portion could be shifted in location, and the fuel 70 sticking to the outer circumferential surface of the sleeve 50 may not efficiently be drawn. To this end, in the fuel injection valve 1 according to the embodiment, projections 50*p* projecting toward the inner radial direction are provided at the inner circumferential surface of the sleeve 50. The cutout grooves 28*k* to be engaged with the projections 50*p* (see FIGS. 7A and 7B) are provided at the outer circumferential surface of the injection hole plate 28. Therefore, the sleeve 50 can be prevented from rotating and the spray characteristics can be prevented from being degraded.

Note that according to the above embodiments, the sleeve 50 is made of resin. However, it may be made of a metal or other suitable material. According to the above embodiments, the injection hole plate 28 is formed into a cup shape. However, a flat injection hole plate may be employed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection valve, comprising:

an injection hole plate provided at a fluid path outlet formed at a tip end of a valve body, said injection hole plate defining a plurality of injection holes, said valve body further including:

a bottom wall portion with a valve seat against which a valve member abuts, and a side wall portion provided upright from a peripheral edge of the bottom wall portion, wherein the side wall portion supports said valve member while said valve member reciprocates, a sleeve fixed to said valve body and abutting said injection hole plate, wherein said injection hole plate:

is cup-shaped and has its entire circumference joined to said valve body to cover said fuel path, has a bottom portion to allow said fuel path to communicate with an exterior of said valve body, and has a cylindrical portion angularly provided from a peripheral edge of said bottom portion and press-fitted onto said side wall portion, wherein said sleeve:

is a resin sleeve and has a resin annular portion defining an opening opened toward a downstream direction of the fuel injected from said injection hole plate, and a resin cylindrical portion provided upright from a peripheral edge of the resin annular portion and press-fitted onto said side wall portion, wherein one of said sleeve and said injection hole plate has a projection and the other has a cutout groove corresponding to said projection so that said sleeve and said injection hole plate are engaged with each other in a manner such that ends of said projection in a circumferential direction and ends of said cutout groove in said circumferential direction are in contact with each other to counter sleeve rotation in the circumferential direction, and wherein said fuel injection valve injects a fluid from the injection holes, controls an amount of the fluid, and determines an injection direction.

2. The fuel injection valve according to claim 1, wherein said resin cylindrical portion press-fitted onto said side wall portion includes a press-fitting portion that can be press-fitted onto said side wall portion at an axial end of said valve body, said cutout groove of said resin cylindrical portion having a shape that can engage with said projection is provided at the inner circumference of the resin cylindrical portion between said press-fitting portion and said resin annular portion, and said cylindrical portion press-fitted onto said side wall portion is provided with said projection, corresponding to said cutout groove, at the outer circumference of said cylindrical portion.

3. The fuel injection valve according to claim 1, wherein said resin cylindrical portion press-fitted onto said side wall portion includes a press-fitting portion that can be press-fitted onto said side wall portion at an axial end of said valve body, said projection is provided at the inner circumference of said resin cylindrical portion between said press-fitting portion and said resin annular portion, and said injection hole plate defines said cutout groove having a shape that accommodates said projection at the outer circumference of said cylindrical portion.

4. The fuel injection valve according to claim 1, wherein said press-fitting portion is provided at about an equal pitch around the inner circumference of said resin annular portion, and said projection and said press-fitting portion are arranged so that their circumferential positions do not overlap.

5. The fuel injection valve according to claim 3, further comprising:

an annular rib at an axial end of said cylindrical portion, wherein said cutout groove provided in said cylindrical portion is provided at said rib.

6. The fuel injection valve according to claim 2, wherein said projection of said cylindrical portion is made of a rib extending in the radial direction from the axial end of said cylindrical portion.

7. The fuel injection valve according to claim 1, wherein said opening is approximately elliptical.

8. The fuel injection valve according to claim 1, wherein said injection holes are arranged annularly but any individual injection hole is not symmetrical with respect to a longitudinal axis of the fuel injection valve, but said injection holes are symmetrical to a line drawn on or parallel to said injection hole plate, such that axial lines of the injection holes radially extend toward the downstream side with respect to the axial direction of the fuel injection valve.

9. A fuel injection valve, comprising:

a valve body provided with a valve seat at an inner wall surface and defining a fluid path;

a valve member seating at the valve seat to open and close said fluid path;

an injection hole plate attached to said valve body on the fluid downstream side of said valve member and defining a plurality of injection holes; and a cup-shaped sleeve attached to said valve body to cover an outer circumference of said injection hole plate, wherein said fuel injection valve injects fuel from the injection holes, said sleeve defines an opening from which fuel injected from said injection holes is discharged, and one of said sleeve and said injection hole plate being provided with a projection, while the other being provided with a cutout groove corresponding to said projection, so that said sleeve and said injection hole plate may engage with each other in a manner such that ends of said projection in a circumferential direction and ends of said cutout groove in said circumferential direction are in contact with each other to counter sleeve rotation in the circumferential direction.

10. The fuel injection valve according to claim 9, wherein a plurality of said projections and a plurality of said cutout grooves are provided around the circumference of the respective one of said cup-shaped sleeve and injection hole plate.

11. The fuel injection valve according to claim 10, wherein said projections project radially inward from an inner circumferential surface of said sleeve, and said cutout grooves that engage with the projection are in an outer circumference surface of said injection hole plate.

12. The fuel injection valve according to claim 11, wherein said opening is formed into an approximately elliptical shape.

13. A fuel injection valve comprising:

a valve body provided with a valve seat at an inner wall surface and defining a fluid path;

a valve member seating at the valve seat to open and close said fluid path;

an injection hole plate attached to said valve body on the fluid downstream side of said valve member and defining a plurality of injection holes; and a cup-shaped sleeve attached to said valve body to cover an outer circumference of said injection hole plate, wherein said fuel injection valve injects fuel from the injection holes, said sleeve defines an opening from which fuel injected from said injection holes is discharged, and one of said sleeve and said injection hole plate being provided with a projection, while the other being provided with a cutout groove corresponding to said projection, so that said sleeve and said injection hole plate may engage with each other and further comprising a negative pressure generating portion provided around said opening for generating negative pressure by flowing fuel from said opening and drawing fuel sticking to said sleeve outer circumferential surface.

14. The fuel injection valve according to claim 13, wherein said negative pressure generating portion has a raised portion provided at the end of said sleeve opposite to the injection hole plate side and projecting in a direction away from said injection fuel plate and a through hole penetrating through the raised portion from said outer circumferential surface to the inner circumferential surface, and fuel sticking to the outer circumferential surface of the sleeve is drawn toward the inner circumferential side of said raised portion through said hole when the fuel is flown out from said opening.

15. The fuel injection valve according to claim 13, wherein a plurality of said projections and a plurality of said cutout grooves are provided around the circumference of the respective one of said cup-shaped sleeve and injection hole plate.

16. The fuel injection valve according to claim 15, wherein said projections project radially inward from an inner circumferential surface of said sleeve, and said cutout grooves that engage with the projection are in an outer circumference surface of said injection hole plate.

17. The fuel injection valve according to claim 16, wherein said opening is formed into an approximately elliptical shape.

* * * * *